US005172350A

United States Patent [19]

Walen et al.

[11] Patent Number: 5,172,350

[45] Date of Patent: Dec. 15, 1992

[54] TIMEKEEPING DEVICE

[76] Inventors: Alec Walen, 905 Maryland Ave., No. 8, Pitsburgh, Pa. 15232; Pepyn van Zoest, Krombooms sloot 73I, 1011 GT Amsterdam, Netherlands, 020-261088

[21] Appl. No.: 640,955

[22] Filed: Jan. 14, 1991

[51] Int. Cl.[5] ..... G04B 19/04

[52] U.S. Cl. ..... 368/238; 368/228

[58] Field of Search ..... 368/238, 223–241, 368/79, 80

[56] References Cited

U.S. PATENT DOCUMENTS 3,952,500 4/1976 Tomura ..... 368/185
4,254,493 3/1981 Billet ..... 368/185
4,601,585 7/1986 Farley ..... 368/185
4,885,729 12/1989 Lee ..... 368/185
4,995,021 2/1991 Sullivan ..... 368/185

*Primary Examiner*—Bernard Roskoski
*Attorney, Agent, or Firm*—Ostrolenk, Faber, Gerb & Soffen

[57] ABSTRACT

Timekeeping devices such as clocks and watches have an aesthetically attractive single-hand indicator for the time-of-day. The single hand moves to indicate changing time relative to a substantially immobile face, preferably marked with an aesthetic design, hour lines, numerals, and the like. The mechanism for moving the single-hand is substantially hidden from view. In some embodiments the single-hand is anchored on one side only.

6 Claims, 4 Drawing Sheets

VI

TIMEKEEPING DEVICE

BACKGROUND OF THE INVENTION

The present invention relates to timekeeping devices such as clocks and watches, and particularly to novel mechanisms for providing such devices with an aesthetic single-hand indication of the time-of-day.

In recent years, clocks have been provided, for ornamental or aesthetic purposes, with time-indicating hands which vary from the traditional two hands extending from the center of the clock face outwardly toward its periphery. For example, U.S. Pat. No. 3,952,500 adds appendages to the end of otherwise traditional clock hands. The traditional clock hands move the appendages in a coordinated motion and cause formation of aesthetic shapes as the clock hands move.

U.S. Pat. No. 4,712,924, in one embodiment, dispenses with the traditional two hands altogether, and provides a single hand which indicates the time-of-day by the position of its two end points. While the one-hand design of U.S. Pat. No. 4,712,924 is aesthetically pleasing, there are certain aesthetic limitations which are imposed by the mechanism used to move the single hand disclosed in that patent. In one embodiment, the mechanism is visible in addition to the single hand, and includes two traditional hands, the endpoints of which are connected by the "single" hand. This results in a usually triangular design on the clock face somewhat analogous to the parallelogram usually formed by the hands of the device of U.S. Pat. No. 3,952,500, discussed above. Some of the character of a single hand time indication is lost in this embodiment.

In another embodiment of U.S. Pat. No. 4,712,924, the watch face shows only a single hand. However, the mechanism for moving the single hand involves rotation of the watch face itself, and of parts of the watch face relative to each other. This necessarily limits the extent to which the face can be marked or designed because any original configuration of such markings or designs on a movable part would become scrambled as different parts of the watch face move relative to each other during operation.

SUMMARY OF THE INVENTION

It is an object of the present invention to provide an aesthetically pleasing clock, watch or other timekeeping device wherein time is indicated by the position of a single hand.

It is another object of the invention to provide a single-hand timekeeping device wherein the mechanism for moving the single hand is substantially hidden from view.

It is another object of the invention to provide a single-hand timekeeping device having an immobilized clock face comprising components most of which do not move relative to each other during operation.

The above and other objects are achieved by providing a timekeeping device comprising:

(a) a substantially planar observation surface comprising one or more surface members fixedly mounted relative to each other and in a substantially common plane;

(b) a single time-indicating hand parallel to said observation surface, said indicating hand having first and second ends whose positions relative to said observation surface define a time-of-day;

(c) a control means for causing said indicating hand to change position over time relative to said observation surface at a rate which causes said indicating hand to change its time-of-day indication at a rate equal to actual passage of time;

(d) a connecting means which joins said time-indicating hand to said control means;

wherein, from at least one observation position, said time-indicating hand is visible across a portion of said observation surface and said control means is substantially blocked from view by said observation surface.

In one preferred embodiment, two annular gaps of different radii appear in the observation surface, and the time-indicating hand is attached both to a first member which moves along the inner gap at a rate of one circuit every twelve hours and also to a second member which moves along the outer gap at a rate of one circuit per hour. The time-indicating hand may be of variable length such that it is constantly attached to the first and second members at its end point only, its end points varying closer and farther from one another as the two members move closer and farther from one another during their normal circuits along their respective annular gaps. Alternatively, the time-indicating hand may be of constant length in which case its ends do not move closer or farther apart as the two members with which the hand is connected move closer or farther apart during their circuits of their respective annular gaps. When the time-indicating hand is of constant length, it is preferred that the hand be rotatably joined to one member and slidably joined to the other. The member to which the hand is slidably joined slides toward the end of the hand which is rotatably joined whenever the two members move closer to each other, and slides away from the end of the hand which is rotatably joined whenever the two members move away from each other.

In other embodiments, one end of a time indicating hand travels a single annular gap to indicate, for example, hours, and rotates its other (free) end toward a position indicative, for example, of minutes past the hour. The free end may be either the hour-indicating or the minute-indicating end.

Other features and advantages of the present invention will become apparent from the following description of the invention which refers to the accompanying drawings.

BRIEF DESCRIPTION OF THE DRAWING(S)

For the purpose of illustrating the invention, there is shown in the drawings several embodiments which are presently preferred, it being understood, however, that this invention is not limited to the precise arrangements and instrumentalities shown.

DETAILED DESCRIPTION OF THE PREFERRED EMBODIMENTS

Figure 2:
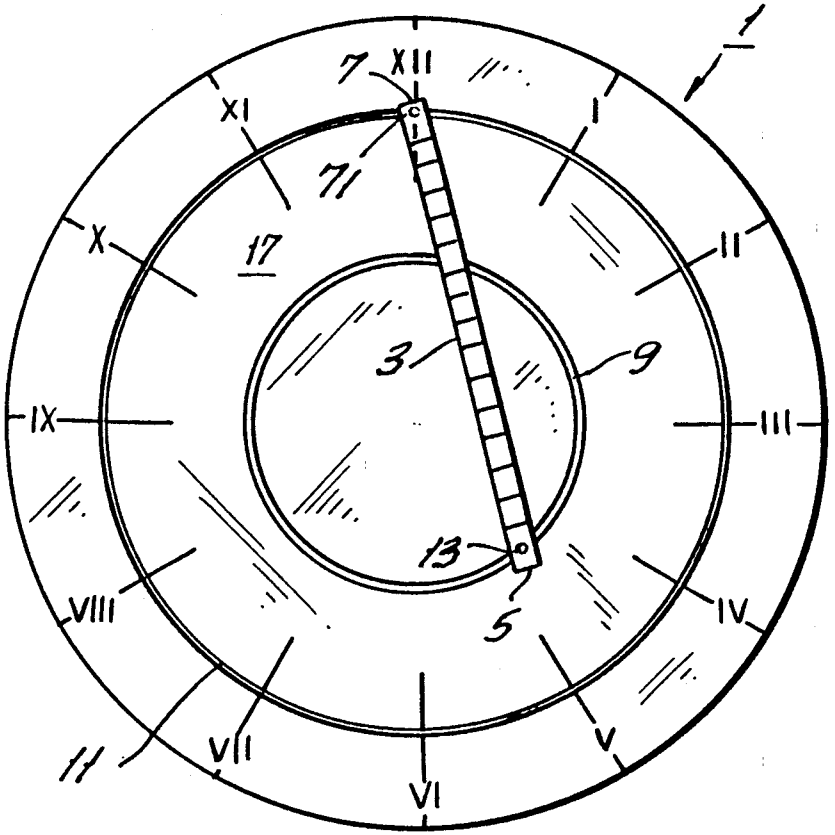
FIG. 2 is the same clock face as shown in FIG. 1 wherein the time-of-day indicated is 5:00.
Figure 1:
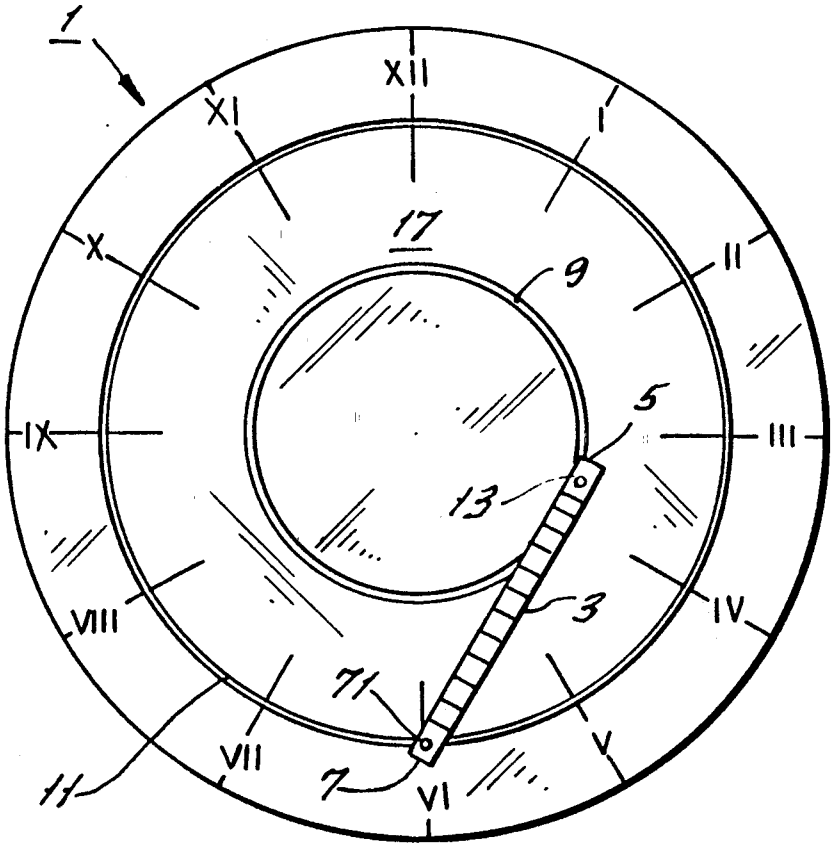
FIG. 1 is a preferred clock face in accordance with the invention wherein the time-of-day indicated is 3:30.

Referring now to the drawings wherein like numerals indicate like elements, there is shown in FIGS. 1 and 2 a clock face 1 of a preferred embodiment of the invention including, generally, a substantially planar observation surface 17 and a single time indicating hand 3. In FIG. 1, hand 3 indicates a time of 3:30 defined by the respective locations of hour end 5 and minute end 7 of hand 3. Hour end 5's location along inner annular gap 9 between the 3:00 and 4:00 position of clock face 1 indicates a time between 3:00 and 4:00. Minute end 7's location along outer annular gap 11 (at the VI position of the clock face) is indicative of 30 minutes past the hour. FIG. 2 shows the changed position of hand 3 one and one-half hours later when hand 3 has moved to indicate a time of 5:00. In the embodiment of FIGS. 1 and 2, hand 3 is a variable length member which elongates and contracts as ends 5 and 7, thereof, move apart and together during operation of the clock.

Figure 4:
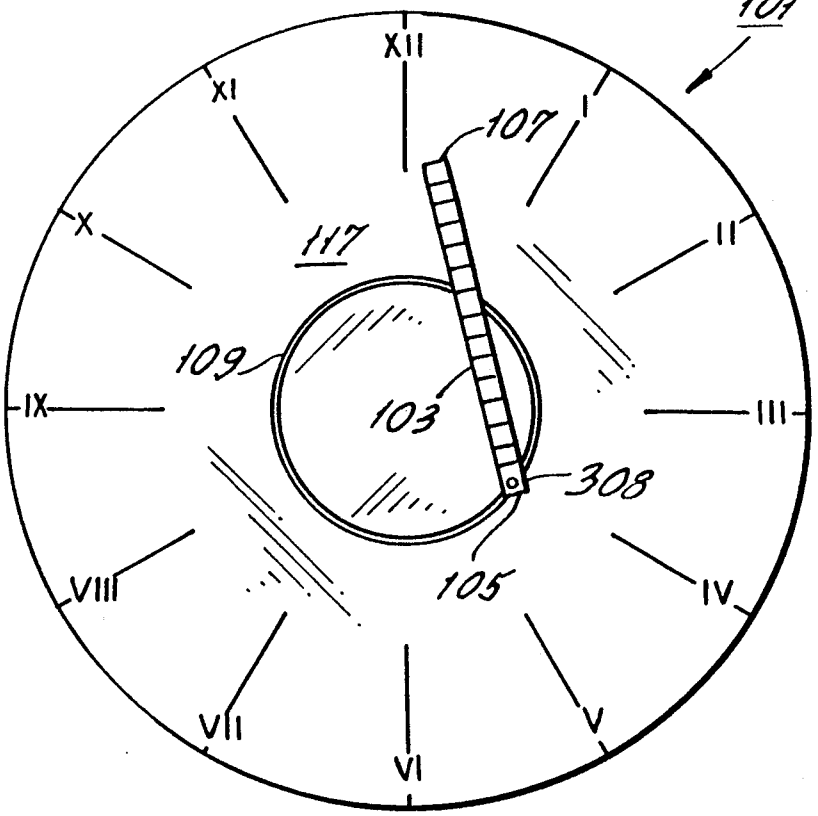
FIG. 4 is the clock face of FIG. 3 wherein the time-of-day indicated is 5:00.
Figure 3:
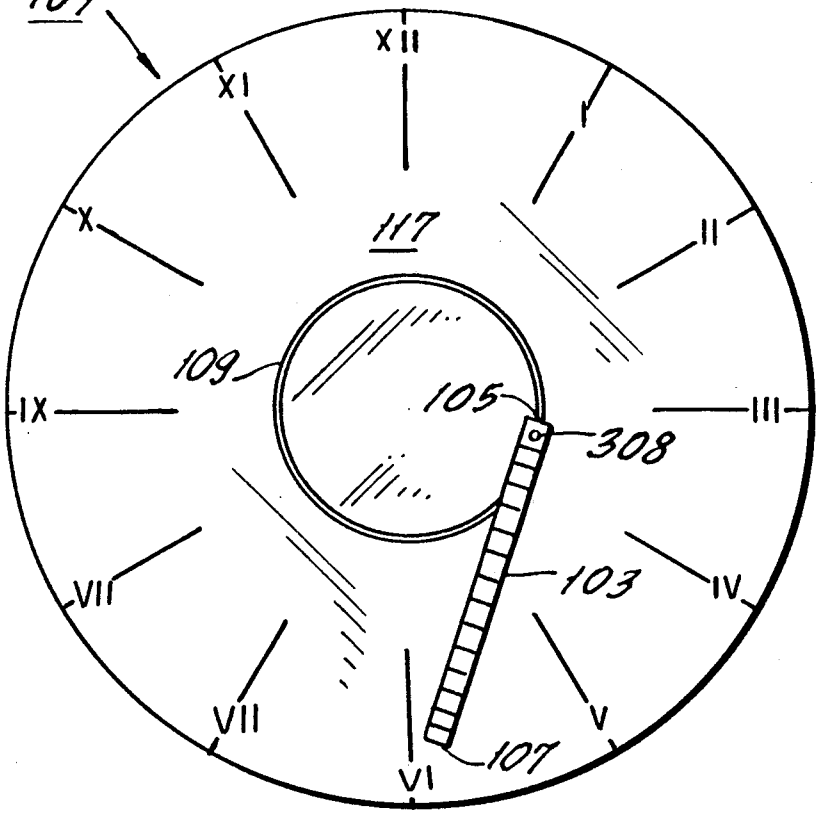
FIG. 3 is a clock face of an alternative embodiment of the invention wherein the time-of-day indicated is 3:30.

FIGS. 3 and 4 illustrate a clock face of one alternative embodiment of the invention wherein single hand 103 indicates a time of 3:30 in FIG. 3 and of 5:00 in FIG. 4. In the alternative embodiment, only one annular gap 109 appears in observation surface 117. Only hour end 105 of hand 103 moves along annular gap 109 to indicate the hour. Minutes are determined by the direction to which minute end 107 points, and not by minute end 107's intersection with any second annular gap, as is the case in the embodiment of FIGS. 1 and 2.

Figures 5, 6, 7, 8:
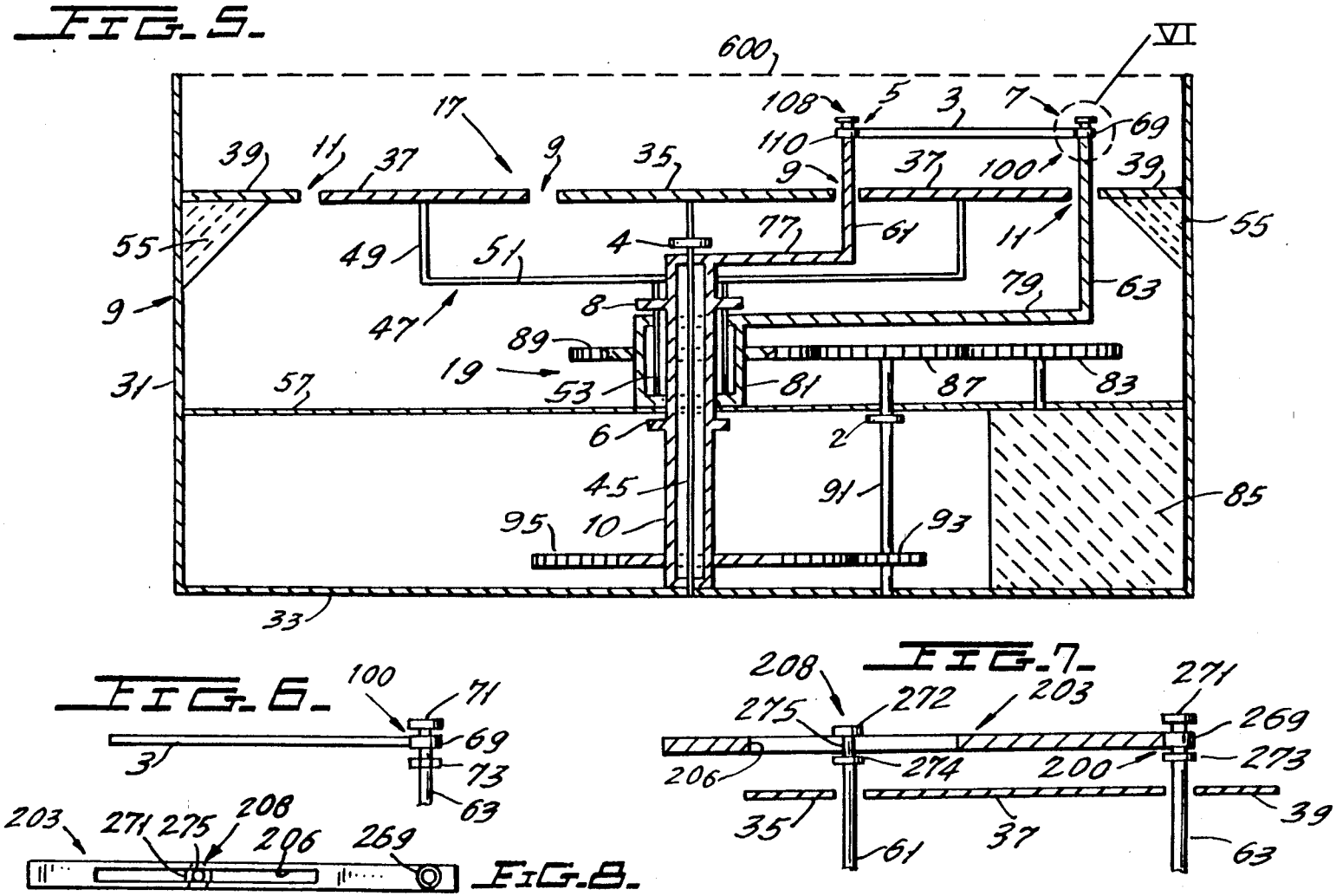
FIG. 5 is a cross-section of a preferred timekeeping device of the invention, capable of presenting a clock face as in FIGS. 1 and 2, and controlled by a preferred and substantially hidden mechanism.
FIG. 6 is an enlarged view of the rotatable connection between hand 3 and vertical post 63 of FIG. 5.
FIG. 7 is a cross-sectional view of an alternative slidably-mounted time-indicating hand and its connections to vertical posts 61 and 63 of FIG. 5.
FIG. 8 is a top view of the time-indicating hand shown in FIG. 7.

In all of the foregoing embodiments, the control means for moving the single hand are substantially hidden from view in order to enhance the aesthetic appeal of the device. There is shown in FIG. 5 a cross-section of a preferred timekeeping device in accordance with the invention showing a control means (generally 19) which is substantially hidden from external view, and which controls the motion of single time-indicating hand 3 above substantially planar and stationary observation surface 17. Surface 17 is preferably marked with the traditional lines and numbers of a standard clock face. Control means 19 causes hand 3 to change position and orientation over time in a manner by which hand 3 continuously and accurately indicates the time-of-day. Time indicating hand 3, observation surface 17, and control means 19 are discussed separately and in more detail below.

FIGS. 1 and 2 illustrate one embodiment of the observation surface and time-indicating hand. In FIGS. 1 and 2, hour indicating end 5 and minute indicating end 7 of hand 3 travel circular paths along annular gaps 9 and 11, respectively, at different rates (one circuit per hour along outer gap 11 and one circuit per 12 hours along inner gap 9). Hand 3 is of variable length and may be constructed in a variety of ways. For example, hand 3 may be comprised of an elastic material stretchable to allow ends 5 and 7 to move apart, but elastically returnable to a shorter state as ends 5 and 7 move together. Preferably, however, hand 3 is comprised of a rigid material wherein two separate pieces of hand 3 are linearly and slidably joined. For example, hand 3 may be a telescopic rod such as that described in U.S. Pat. No. 4,712,924, col. 1, lines 36–39, and as shown as element 150 of FIG. 8 of U.S. Pat. No. 4,712,924.

As yet another alternative, the time-indicating hand may be of fixed length and slidably attached to a connecting means moving along one of the two annular gaps. FIGS. 7 and 8 illustrate a fixed length hand 203 usable in such an alternative embodiment. Hand 203 includes a collar 269 for receiving and attaching a first connecting means 200 which travels, driven by the control means 19, along, for example, annular gap 11. Hand 203 further includes slot 206 for slidably receiving a second connecting means 208 which travels along, for example, annular gap 9. The connecting means to which opening 269 and slot 206 attach may be reversed. During operation of the timekeeping device, second connecting means 208 slides along slot 206 in the direction of collar 269 as the distance between first connecting means 200 and second connecting means 208 decreases and slides away from collar 269 as the distance between the two connecting means increases.

In the embodiments shown in FIGS. 3 and 4, end 105 of hand 103 moves along annular gap 109 during operation. Hand 103 is rotatable about an axis centered at connecting means 308 and substantially perpendicular to said observation surface 17. Free end 107 is unconnected and its position depends upon the rotation of hand 103 about connecting means 308. In the embodiment shown in FIGS. 3 and 4, hand 103 may be of constant length, and need not be adjustable so that its end points touch inner and outer annular gaps of the clock face. In this embodiment, the minutes are indicated by the direction in which hand 103 points rather than by the exact position of minute-indicating end 107. In an alternative embodiment, an annular gap with a greater radius than gap 109 runs near the perimeter of the clock face. In this embodiment, the minute-indicating end of the single hand is affixed within the annular gap and the hour-indicating end points to a position along an inner circle indicative of the hour of day.

As previously mentioned, it is highly desirable that the mechanism which moves the single hand of the timekeeping device be substantially hidden from view from the normal observation position in front of the clock face. From this position, it is desirable that only the planar observation surface and the time indicating hand be visible. There is shown in FIG. 5 a casing 29 which encloses most of the drive mechanism generally shown as 19. The casing includes sidewall 31 and base 33. Sidewall 31 extends above planar observation surface 17 and may support transparent cover 600 which is preferably comprised of a highly transparent glass or plastic material through which observation surface 17 and the single hand 3 may be clearly seen. Observation surface 17 is comprised of a face plate 35, an annular rim 37 and an annular ledge 39. Each of face plate 35, annular rim 37 and annular ledge 39 are substantially coplanar one with the other. Face plate 35 and annular rim 37 are spaced from each other sufficiently to leave a first annular gap 9. Annular rim 37 and annular ledge 39 are sufficiently spaced from each other to leave therebetween a second annular gap 11. Face plate 35 is fixedly attached to and supported by support member 45 which is fixedly mounted upon base 33. Annular rim 37 is supported by rim support member 47 which includes a vertical region 49, a horizontal region 51 and a cylindrical region 53 which spacedly encircles support member 45. Annular ledge 39 extends directly out from sidewall 31 of casing 29. An annular bracing member 55 may support annular ledge 39. Cylindrical portion 53 is fixedly attached to intermediate surface 57.

Control means 19 controls the position and orientation of single time-indicating hand 3 and is connected thereto by first and second connecting means 108 and 100, respectively. Connecting means 108 comprises a first vertical post 61 to which hour-indicating end 5 of hand 3 is rotatably joined by a rotatable collar 110 which loosely encircles post 61 and is fixedly joined or integral with hand 3. Connecting means 100 (shown in greater detail in FIG. 6 and including parts analogous to those of means 108) comprises a second vertical post 63 to which minute end 7 of hand 3 is rotatably joined by rotatable collar 69 which loosely encircles post 63 and is fixedly joined to, or integral with, hand 3. Connecting means 100 further includes upper stop 71 and lower stop 73 for maintaining collar 69 therebetween. In an alternative embodiment shown in FIG. 7, a rigid hand 203 of non-variable length is rotatably joined to second vertical post 63 in the same manner as shown in FIG. 6. However, hand 203 is slidably joined to first vertical post 61 as shown in FIGS. 7 and 8. Hand 203 is maintained above post 61 by a slide post 275 which extends through slot 206 of hand 203 (FIG. 7). Stops 272 and 274 stabilize hand 203 against vertical motion. Upper stops 271 and 272 of FIG. 7, and upper stop 71 of FIG. 6 are preferably colored or marked in a manner to contrast with observation surface 17, thus making the hour or minute indicating points more vivid.

Vertical posts 61 and 63 are fixedly joined or integrally formed with horizontal posts 77 and 79, respectively, of control means 19. In general, any parts or members referred to herein as fixedly joined may alternatively be integrally formed as a single part.

Horizontal post 77 is fixedly joined to rotatable cylinder 10 which is rotatable about its vertical axis and is rotatably mounted upon base 33. Cylinder 10 surrounds support member 45 and is in turn surrounded by the cylindrical region 53 which supports annular rim 37. Cylinder 10 rotates about its axis of rotation at a rate of one revolution every 12 hours. This motion causes horizontal post 77 to move vertical post 61 one entire circuit through first annular gap 9 during the same 12 hour period.

In like manner, horizontal post 79 moves vertical post 63 one entire circuit through second annular gap 11 for every rotation of cylindrical member 81. Cylindrical member 81 is fixedly joined to horizontal post 79, surrounds cylindrical region 53 and is rotatably joined to intermediate surface 57 so that cylinder 81 may rotate about its vertical axis. A series of gears 83, 87, and 89 causes cylinder 81 to rotate one complete revolution per hour, and thus to cause horizontal post 79 to move vertical post 63 through second annular gap 11 at a rate of one complete circuit every hour.

In the preferred embodiment shown in FIG. 5, a series of gears are utilized to rotate cylinders 10 and 81. However, a single initiating gear 83 powered by power source 85 powers both series of gears. Gear 83 turns at a constant rate and meshes with gear 87 which in turn meshes with gear 89 which is fixedly attached to cylinder 81. Gears 87 and 89 are of proper dimension relative to gear 83, and to its rate of rotation, to cause cylinder 81 to rotate at a constant rate of one revolution per hour. The rate of rotation of gear 87 is transmitted through translation post 91 to gear 93. Gears 93 and 87 are both fixedly attached to translation post 91. Gear 93 meshes with Gear 95, and Gear 95 in turn is fixedly attached to cylinder 10. Gears 95, 93 and 87 are of a size relative to gear 83 and to its constant rate of rotation, to cause cylinder 79 to rotate at a constant rate of one revolution per 12 hours. Translation post 91 is stabilized in a proper position by stop 2. Cylinder 10 is maintained in a proper position by stops 4 and 6. Cylinder 81 is maintained in a proper position by stop 8.

Figure 9:
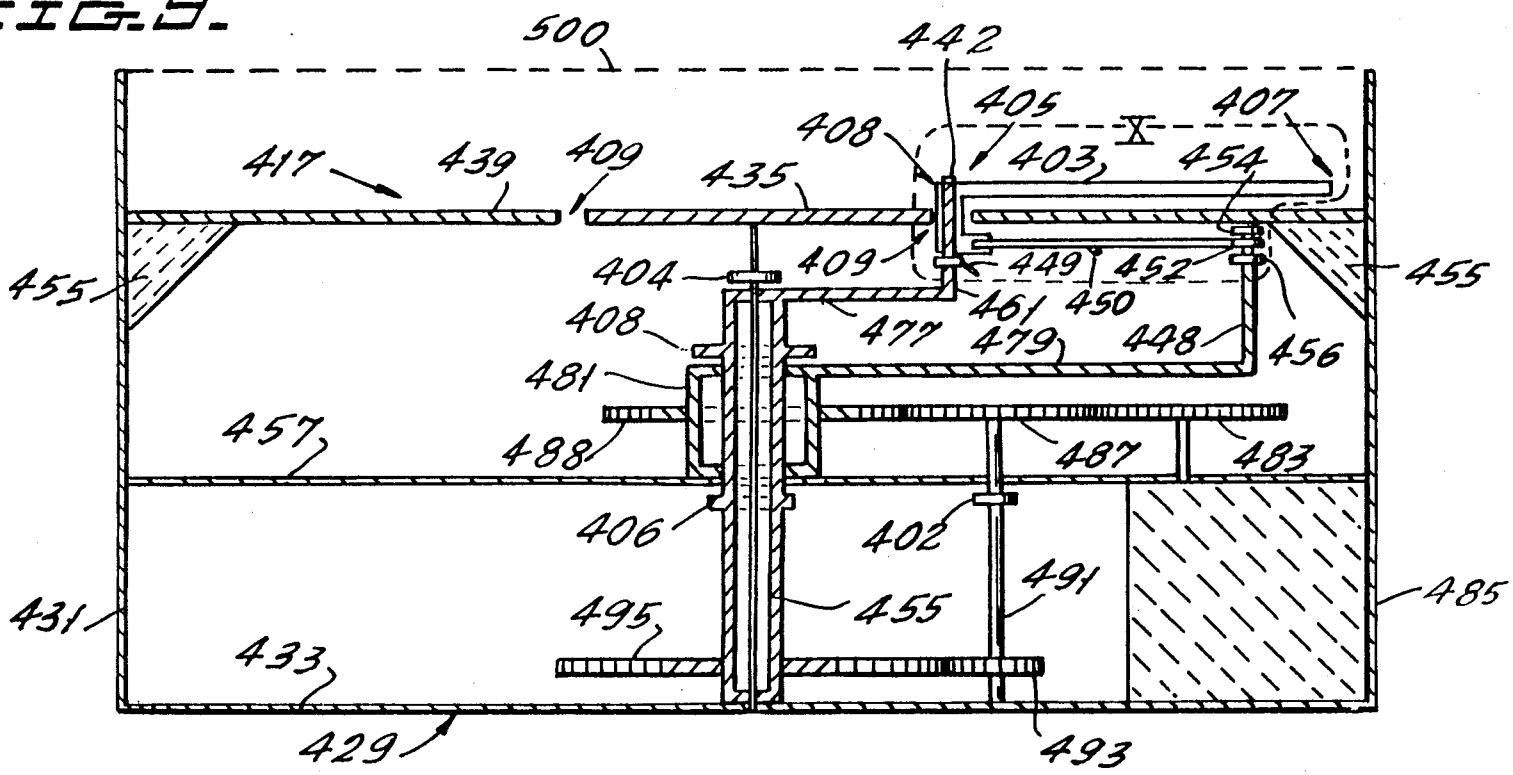
FIG. 9 is a cross-sectional view of one alternative embodiment of the timekeeping device of the invention wherein a time-indicating hand is rotatably mounted upon a single pin travelling a single annular gap.
Figure 10:
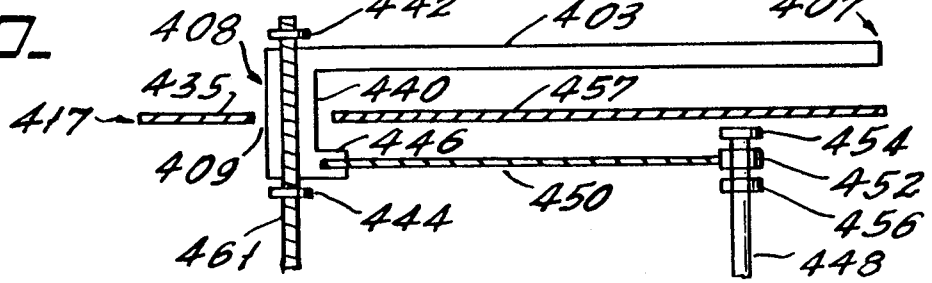
FIG. 10 is an enlarged sectional view of the time-indicating hand and its biasing means shown in FIG. 9.

FIGS. 9 and 10 illustrate an alternative embodiment of the timekeeping device of the present invention wherein time-indicating hand 403 is connected to its control means (generally 419) at only its hour-indicating end 405. Minute-indicating end 407 is free, and indicates minutes past the hour by the direction it points, which is dependent upon hand 403's rotation about connecting means 408. As shown in more detail in FIG. 10, connecting means 408 includes a vertical post 461 which extends perpendicular to the observation surface through an annular gap 409. Connecting means 408 further includes rotatable sleeve 440 which is integrally formed with hand 403, is substantially cylindrical in shape and is rotatably mounted upon post 461. Connecting means 408 further includes stops 442 and 444 which maintain rotatable sleeve 440 in place. Appendage 446 protrudes from rotatable sleeve 440 at a position beneath the plane of observation surface 417. Vertical post 461 and appendage 446 of connecting means 408 are each fixedly attached to said control means in a manner which, as described below, enables said control means to cause said connecting means to move and orient hand 403 in an appropriate manner to continuously indicate an accurate time-of-day.

Control means 419 includes a hand orientation means for interacting with appendage 446 of connecting means 408 in order to cause controlled rotation of hand 403 by rotating rotatable sleeve 440. The orientation means includes vertical post 448 and orientation member 450 which is rotatably mounted to post 448 by being fixedly attached to rotatable collar 452 which is rotatably mounted upon post 448 and maintained in proper position between stops 454 and 456. Orientation means 450 is a variable length element which biases tab 446 in the direction of post 448 and, in so doing, rotates sleeve 440 and hand 403 about post 461, causing the minute-indicating end 407 of hand 403 to maintain a position directly above post 448 with annular ledge 439 therebetween. The remainder of control means 419 causes post 448 to move in a circular manner beneath observation surface 417 at a rate of one circuit per hour in a manner such that post 448 is beneath a position which, on the top side of annular ledge 439, is indicative of minutes past the hour. Because the biasing means causes minute-indicating end 407 of hand 403 to point in the direction of post 448, minute-indicating end 407 necessarily points toward a region of annular ledge 439 indicative of minutes past the hour even though post 448 is hidden from view.

Hand 403 is rotatably mounted at its hour-indicating end 405 (through rotatable sleeve 440) onto post 461. Control means 419 causes post 461 to move along annular gap 409 at a rate of one circuit every 12 hours and thereby causes hour-indicating portion 405 of hand 403

(which is connected therewith) to constantly and accurately indicate the hour of day.

In an alternative embodiment, the single annular gap is of greater radius and near the periphery of observation surface 417. In this alternative embodiment, the functions of posts 448 and 461 are reversed, post 448 extending through the annular gap and providing a portion of the connecting means and post 461 remaining entirely below observation surface 417 and assuming a hand-biasing function. In that alternative, the rotatable and fixed connections are reversed from those shown in FIG. 9.

Hand 403 of FIG. 9 is preferably of a length greater than the diameter of face plate 435 so that its minute-indicating end 407 always extends beyond face plate 435 and toward the minute-indicating periphery of observation surface 417, even when hand 403 is oriented through the center of face plate 435 (e.g., when indicating a time of 9:15).

The remainder of the timekeeping device shown in FIG. 9 is substantially analogous to the structure illustrated in the embodiment of FIG. 5 discussed earlier. There is, however, no annular rim 37 nor support therefor since, in the embodiment of FIG. 9 it is necessary to create only one annular gap and since support for an annular rim could interfere with hand-biasing member 450 during operation of the device of FIG. 9.

There is shown in FIG. 9 a casing 429 which encloses most of the drive mechanism generally shown as 419. The casing includes side wall 431 and base 433. Side wall 431 extends above planar observation surface and may support transparent cover 500 which is preferably comprised of a highly transparent glass or plastic material through which observation surface 417 and the single hand 403 may be clearly seen. Observation surface 417 is comprised of a face plate 435 and an annular ledge 439. Face plate 435 and annular ledge 439 are substantially coplanar, one with the other. Face plate 435 and annular ledge 439 are sufficiently spaced from each other to leave therebetween an annular gap 409. Face plate 435 is fixedly joined to, and supported by, support member 445 which is fixedly mounted upon base 433. Annular ledge 439 extends directly out from side wall 431 of casing 429 and annular bracing member 455 may support annular ledge 439.

Control means 419 controls the position and orientation of single time-indicating hand 403 and is connected thereto by connecting means 408, which is described in more detail above. Vertical post 461 of connecting means 408 is fixedly joined or integrally formed with horizontal post 477 of control means 419. Horizontal post 477 is fixedly joined to rotatable cylinder 410 which is rotatable about its vertical axis and is rotatably mounted upon base 433. Cylinder 410 surrounds support member 445. Cylinder 410 rotates about its axis of rotation at a rate of one revolution every 12 hours. This motion causes horizontal post 477 to move vertical post 461 (and the connecting means and time-indicating hand associated therewith) one entire circuit through annular gap 409 during the same 12 hour period.

In like manner, horizontal post 479 which is fixedly connected or integrally formed with vertical post 448 of the hand biasing means moves vertical post 448 one entire circuit along an annular path which is beneath the plane of observation surface 417 and is substantially centered about support member 445. Vertical post 448 completes one circuit of its annular path for every complete revolution of cylindrical member 481 to which it is connected by horizontal post 479 which is fixedly joined to both cylinder 481 and vertical post 448. Cylindrical member 481 surrounds cylinder 410 and is rotatably joined to intermediate surface 457 so that cylinder 481 may rotate about its vertical axis. A series of gears 483, 487, and 489 causes cylinder 81 to rotate one complete revolution per hour, and, thus, to cause horizontal post 479 to move vertical post 448 along its annular path at a rate of one complete circuit every hour.

In the preferred embodiment shown in FIG. 9 a series of gears are utilized to rotate cylinders 410 and 481. However, a single initiating gear 483 powered by power source 485 powers both series of gears shown. Gear 483 turns at a constant rate and meshes with gear 487 which, in turn, meshes with gear 489 which is fixedly attached to cylinder 481. Gears 487 and 489 are of proper dimension relative to gear 483, and to its rate of rotation, to cause cylinder 481 to rotate at a constant rate of one revolution per hour. The rate of rotation of gear 487 is transmitted through translation post 491 to gear 493. Gears 493 and 487 are both fixedly attached to translation post 491. Gear 493 meshes with gear 495, and gear 495, in turn, is fixedly attached to cylinder 410. Gears 495, 493 and 487 are of a size relative to gear 483 that, considering its constant rate of rotation, causes cylinder 410 to rotate at a constant rate of one revolution per 12 hours. Translation post 491 is stabilized in a proper position by stop 402. Cylinder 410 is maintained in a proper position by stops 404 and 406. Cylinder 481 is maintained in proper position by stop 408.

Although the present invention has been described in relation to particular embodiments thereof, many other variations and modifications, and other uses will be readily apparent to those skilled in the art. The description set forth herein is by way of illustration only and is not intended to set forth any limitation on the scope of the claimed invention, which scope is defined only by the claims of any issued patent arising herefrom.

What is claimed is:

1. A timekeeping device comprising:

(a) a substantially planar observation surface comprising one or more surface members fixedly mounted relative to each other and in a substantially common plane;

(b) a first substantially circular gap in said observation surface;

(c) a second substantially circular gap in said observation surface, said second gap being concentric with, but spaced from, said first gap;

(d) a first member movable in said first gap and connected to a means for moving said first member along a circular path defined by said first gap at a rate of one complete circuit of said path every twelve hours;

(e) a second member movable in said second gap and connected to a means for moving said second member along a circular path defined by said second gap at a rate of one complete circuit of said path every one hour;

(f) a single time-indicating hand joined both to said first member and to said second member;

wherein, from at least one observation position, said time indicating hand is visible but said means for moving said first member and said means for moving said second member are substantially blocked from view by said observation surface.

2. The timekeeping device of claim 1, wherein said time-indicating hand is of variable length, and wherein a first end of said hand is coupled to said first member and a second end of said hand is coupled to said second member.

3. The timekeeping device of claim 2, wherein said hand is substantially linear.

4. The timekeeping device of claim 1, wherein said hand is of fixed length.

5. The timekeeping device of claim 4, wherein said hand is rotatably joined to one of said first and second members, and wherein said hand is slidably joined to the other of said members.

6. A timekeeping device comprising:

(a) a casing;

(b) a face plate fixedly mounted upon said casing;

(c) an annular rim fixedly mounted and substantially concentric and coplanar with said face plate, said annular rim being spaced from said face plate sufficiently to form an annular gap therebetween;

(d) a first pin substantially perpendicular to said face plate extending through said annular gap and substantially beyond on both sides of said annular gap, said first pin being connected to a first drive means for advancing said pin along said annular gap at a rate of one complete circuit of said annular gap per twelve hours;

(e) a second pin perpendicular to and located entirely beneath the plane of said face plate, said second pin being connected to a second drive means for advancing said second pin along a circular path concentric with, but of greater radius than, said annular gap at a rate of one complete circuit of said circular path per one hour period;

(f) a time-indicator hand rotatably mounted upon said first pin and including an elongated indication portion extending from and perpendicular to said first pin above and parallel to the plane of said face plate, and further including a hollow cylindrical portion surrounding said first pin, both above and below the plane of said face plate, and further including an appendage from said cylindrical portion, said appendage located beneath the plane of said face plate, said indicator hand being rotatable about said first pin;

(g) a variable length connector fixedly connected to said appendage beneath the plane of said face plate and rotatably connected to said second pin;

wherein said variable length connector biases said appendage in the direction of said second pin and causes said indicator hand to rotate about said first pin such that said elongated indication portion points in the direction of said second pin.

* * * * *